US006410890B1

(12) United States Patent
Kohlstrung

(10) Patent No.: US 6,410,890 B1
(45) Date of Patent: Jun. 25, 2002

(54) APPARATUS AND METHOD FOR CLEANING THE INTERIOR OF A COOKING DEVICE

(75) Inventor: Peter Kohlstrung, Kaufering (DE)

(73) Assignee: Rational AG, Landsberg.Lech (DE)

( * ) Notice: Subject to any disclaimer, the term of this patent is extended or adjusted under 35 U.S.C. 154(b) by 0 days.

(21) Appl. No.: 09/829,867

(22) Filed: Apr. 10, 2001

(30) Foreign Application Priority Data

Apr. 12, 2000 (DE) ..... 100 17 966

(51) Int. Cl.[7] ..... F24C 14/100

(52) U.S. Cl. ..... 219/401; 219/401; 219/391; 126/20; 126/369; 99/474

(58) Field of Search ..... 219/391, 393, 219/400, 401; 126/20, 20.1, 20.2, 369; 99/476, 474, 447; 134/104.1, 95.1, 95.3, 166 R, 181; 366/138

(56) References Cited

U.S. PATENT DOCUMENTS

| | | | | |
|---|---|---|---|---|
| 4,700,685 A | * | 10/1987 | Miller | 126/20 |
| 5,499,577 A | * | 3/1996 | Tommasini | 99/476 |
| 5,619,983 A | * | 4/1997 | Smith | 126/348 |
| 5,768,982 A | * | 6/1998 | Violi et al. | 99/476 |
| 6,023,050 A | * | 2/2000 | Violi | 219/401 |

FOREIGN PATENT DOCUMENTS

| | | |
|---|---|---|
| DE | 78 02 001 | 5/1978 |
| DE | 28 42 771 | 10/1980 |
| DE | 41 25 696 | 2/1993 |
| DE | 296 06 655 | 8/1996 |
| DE | 197 30 610 | 10/1998 |
| EP | 0 652 405 | 12/1996 |

OTHER PUBLICATIONS

"Willi Törnig Peter Spellucci"–Numerische Mathematik für Ingenieure und Physiker Band 2: Numerische Methoden der Analysis Springer Verlag 1990.

* cited by examiner

*Primary Examiner*—Teresa Walberg
*Assistant Examiner*—Shawntina T. Fuqua
(74) *Attorney, Agent, or Firm*—Schiff Hardin & Waite

(57) ABSTRACT

In an apparatus and a method for cleaning the inside of a cooking device having a cooking chamber and a blower chamber separated from the cooking chamber via air baffles, an impeller is arranged in the blower chamber for generating a conveying stream in the cooking chamber as well as in the blower chamber, whereby at least one spray nozzle for spraying at least one fluid, such as a cleaning agent, rinse agent, clear rinse agent, decalcification agent, water and/or the like, faces toward the impeller, whereby the spray jet of the at least one spray nozzle in the blower chamber is directed opposite the conveying stream of the impeller.

22 Claims, 1 Drawing Sheet

APPARATUS AND METHOD FOR CLEANING THE INTERIOR OF A COOKING DEVICE

BACKGROUND OF THE INVENTION

The invention is directed to an apparatus and to a method for cleaning the inside of a cooking device having a cooking chamber and a blower chamber separated from the cooking chamber via air baffles, an impeller being arranged in the blower chamber for generating a conveying stream in the cooking chamber as well as in the blower chamber. At least one spray nozzle for spraying at least one fluid, such as cleaning agent, rinse agent, clear rinse agent, decalcification agent, water and/or the like, faces toward the impeller.

For example, DE 28 42 771 A1 discloses an apparatus of the type wherein injection nozzles for a fluid cleaning agent are directed into the intake stream of a blower. The effect of the cleaning agent can thereby be improved by adding a steam generator, a heating element and/or a blower.

Further, EP 0 652 405 B1 also discloses a cleaning device of the type wherein cleaning agent and/or rinse water is or, respectively, are in turn sprayed into the intake region of an impeller via a spray nozzle.

SUMMARY OF THE INVENTION

An object of the present invention is to develop an apparatus of the type as well as the method of the type described above such that it is more efficient, particularly by reduction of components that must be introduced into a cooking device for the purpose of a cleaning and removed therefrom after a cleaning, and by reduction of the amount of required cleaning agent, rinse agent, clear rinse agent, decalcification agent, water and/or the like, which not only saves costs but is also environmentally friendly. With the invention, moreover, accessories of a cooking device, for example a rack as well as external tools, for example a spit, should be capable of being cleaned together with the interior of the cooking device.

The object directed to the apparatus is achieved according to the invention in that the spray jet of the at least one spray nozzle in the blower chamber is directed opposite the conveying stream of the impeller.

It can thereby be provided that the spray jet of the at least one spray nozzle is radially directed onto the impeller.

It can also be provided according to the invention that the at least one spray nozzle is embraced by a nozzle system that preferably comprises at least one nozzle ring concentrically arranged around the impeller.

It is thereby proposed according to the invention that a heating device is arranged between the at least one nozzle ring and the impeller.

Embodiments of the invention can be characterized in that the at least one spray nozzle is connected to at least one preferably manually fillable reservoir upon interposition of at least one pump.

It can thereby be provided that the at least one reservoir is connected to the cooking chamber upon interposition of at least one first valve, and the cooking chamber is connected to a drain upon interposition of at least one second valve, whereby the first and second valve are preferably implemented as one.

It is preferred to have a plurality of spray nozzles whose respective spray jets comprise impinging surfaces in the interior of the cooking device that overlap at least in regions.

A measuring and control system connected to the motor of the impeller, the at least one pump, the at least one valve, the at least one reservoir and/or the heating device for the control of a cleaning regimen can be provided according to the invention.

With the method of the invention, the spray jet of the at least one spray nozzle in the blower chamber is directed opposite the conveying stream of the impeller.

It can thereby be provided that a first time duration $T_B$ for a wetting of the walls of the cooking chamber, preferably including all built-in units in the cooking chamber, and/or of the blower chamber, preferably including all built-in units in the blower chamber, with the at least one fluid is defined via the amount M of the at least one fluid adhering to the walls and by the average precipitation velocity of the at least one fluid against the walls.

It is thereby proposed according to the invention that $M=d\cdot A$, where d is the maximum film thickness of the fluid adhering to the walls and A is the surface of the walls, $v=F/A$, where F is the conveying stream of the at least one fluid to the at least one spray nozzle, and $$T_B = \frac{d\cdot\gamma}{v} = d\cdot\gamma\cdot\frac{A}{F}$$

where $\gamma=v/(\text{lowest precipitation velocity})$ is the distribution error.

Developments of the invention can also be characterized in that the at least one fluid, at least partly upon employment of at least one pump, is circulated from at least one reservoir via the at least one spray nozzle and the impeller into the cooking chamber and is recirculated from the cooking chamber to the at least one reservoir, whereby the quantity of circulated fluid is preferably acquired, particularly in the at least one reservoir.

It can thereby be provided that at least one valve between the at least one reservoir, the cooking chamber and a drain is actuated dependent on a cleaning regimen.

It is also inventively proposed that a second time duration $T_z$ is acquired within which the quantity of circulated fluid falls below a specific set value.

The invention also proposes improvements that are characterized by a cleaning phase wherein a first fluid in the form of a cleaning agent is distributed in the cooking chamber—preferably over a time duration determined from the first time duration $T_B$ and/or the second time duration $T_z$—by an acting phase for the cleaning agent and a rinsing phase wherein a second fluid in the form of rinsing agent, clear rinsing agent and/or water is distributed in the cooking chamber—preferably over a time duration determined from the first time duration $T_B$ and/or the second time duration $T_z$.

It can thereby be provided that, during the cleaning phase, the first fluid at least partially flows into the at least one reservoir via the at least one valve and, during the rinsing phase, the second fluid at least partially flows from the cooking chamber into the drain via the at least one valve.

A cleaning program that can be manually set and/or sequences automatically, preferably comprising at least one cleaning phase, one acting phase and/or one rinsing phase can likewise be inventively provided.

It is thereby inventively proposed that the cleaning program is controlled and/or regulated dependent on how dirty the interior of the cooking device is, on the speed of the impeller, on the conveying quantity of the at least one pump, on the position of the at least one valve, on the filling level of the at least one reservoir and/or on the temperature in the interior of the cooking chamber.

The invention is thus based on the surprising perception that essentially the complete interior of the cooking chamber, including all built-in units thereof, can be moistened with the fluid and, thus, can be cleaned due to a plurality of reflections and/or dispersions of the fluid as a result of spraying an impeller with fluid opposite its conveying stream.

Further features and advantages of the invention derive from the following specification, wherein an exemplary embodiment of the invention is explained in detail by way of example on the basis of schematic drawings.

DESCRIPTION OF THE PREFERRED EMBODIMENTS

Figure 2:
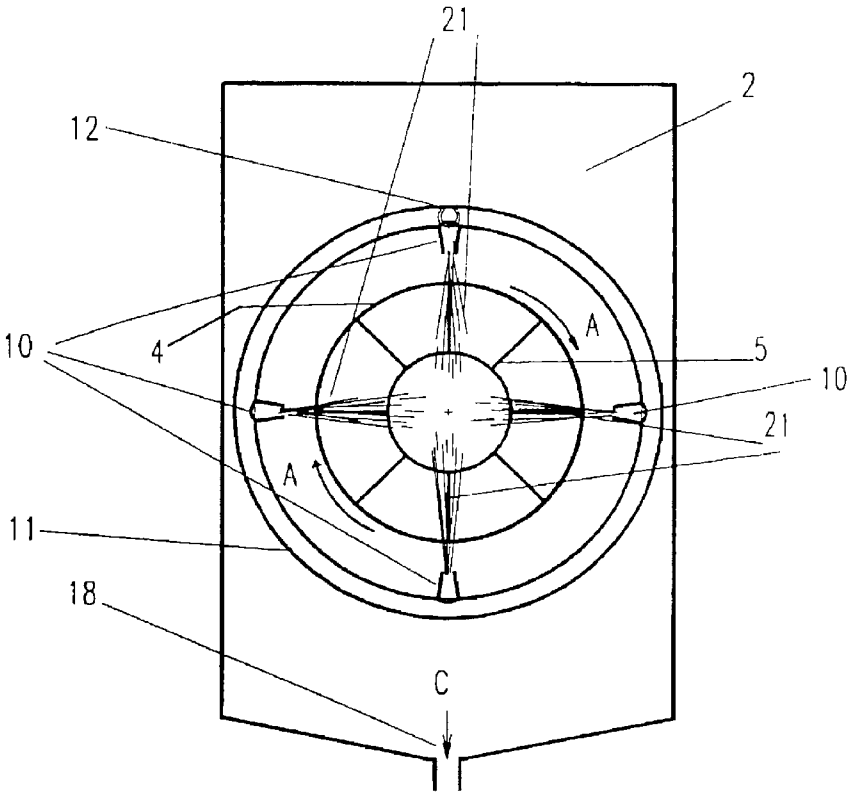
FIG. 2 is a cross-sectional view of the cooking device shown in FIG. 1.

For the purposes of promoting an understanding of the principles of the invention, reference will now be made to the preferred embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 1:
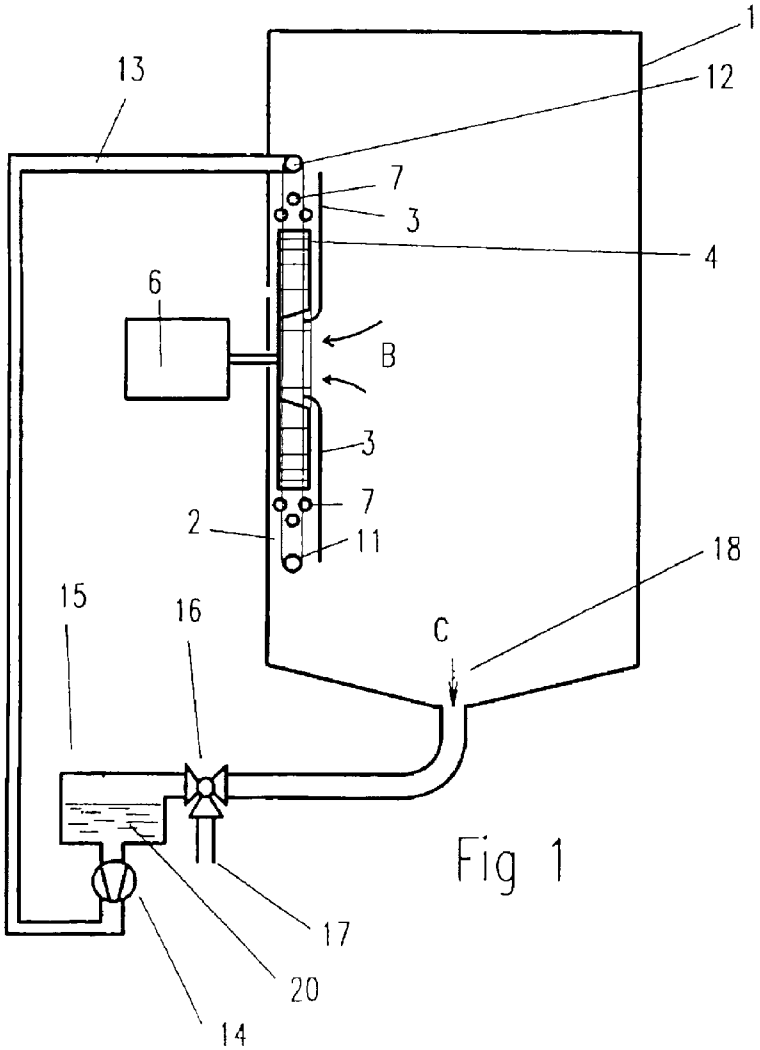
FIG. 1 is a longitudinal sectional view through a cooking device having an apparatus of the invention.

As can be derived from FIG. 1, an interior of a cooking device comprises a cooking chamber 1 and a blower chamber 2 that are separated from one another by air baffles 3. An impeller 4 with paddles 5 that can be driven via a motor 6 as well as a heating device 7 arranged concentrically around the impeller 4 are provided in the blower chamber 2. According to the invention, four spray nozzles 10 are arranged along the circumference of a nozzle ring 11 in the interior of the cooking device, whereby the nozzle ring 11 is connected via a nozzle ring admission 12 to a pump conduit 13 that, via a pump 14, creates a connection to a reservoir 15 that is in turn connectible to the cooking chamber 1 via a valve 16 between a drain 17 and a drain connector 18 of the cooking chamber 1. The reservoir 15 contains a cleaning agent 20 that can be sprayed via the spray nozzles 10 in the form of spray jets 21, namely opposite the conveying direction of the impeller 4, i.e. not in the suction direction B of the impeller 4 as in the Prior Art.

The apparatus that has just been described with reference to FIGS. 1 and 2 thereby functions according to the invention in the following way.

At the beginning of a cleaning regimen, a cleaning phase is automatically initiated during which the cleaning agent 20 is sprayed onto the impeller 4 (rotating in rotational sense A) opposite the conveying direction thereof, being sprayed thereonto via the pump 14, the pump conduit 13, the nozzle ring admission 12, the nozzle ring 11 and the spray nozzles. A part of each of the four spray jets 21 then passes through the impeller 4 and leaves it together with the conveying stream thereof at the opposite side. The majority part of the cleaning agent 20 sprayed with the spray jets 21, however, is entrained by the conveying stream of the impeller 4 and reflections and/or dispersions arise due to high relative velocities. Overall, reflection and/or dispersion of the cleaning agent 20 occurs at essentially all walls in the interior of the cooking device, i.e. the walls of the cooking chamber 1 and of the blower chamber 2, including the built-in units thereof such as the paddles 5 of the impeller 4, the heating device 7, the air baffles 3 as well as further built-in elements that are not shown, for example at a rack. Cleaning agent drops divide, given every reflection and/or dispersion and thus contribute to the further dispersion of the spray jets 21.

It has proven advantageous for an optimally complete wetting of all walls in the interior of the cooking device to select the plurality and alignment of the spray jets 21 dependent on the conveying stream of the impeller 4 such that the corresponding incident surfaces of the cleaning agent against the walls at least partially overlap. The duration of the cleaning phase is thereby preferably defined by the time duration that is needed for a complete wetting of the interior of the cooking device, including built-in units. For this purpose, the amount M of cleaning agent 20 adhering to the walls as well as the average precipitation velocity v of the cleaning agent against the walls are determined, namely as follows:

$M=d\cdot A$, where d is the maximum film thickness of the fluid adhering to the walls and A is the surface of the walls, $v=F/A$, where F is the conveying stream of the at least one fluid to the at least one spray nozzle, and $$T_B = \frac{d\cdot\gamma}{v} = d\cdot\gamma\cdot\frac{A}{F}$$

where $\gamma$=v/(lowest precipitation velocity) is the distribution error.

The cleaning phase is preferably followed by an acting phase for the cleaning agent and, subsequently, by a rinsing phase wherein, in particular, water is sprayed into the interior of the cooking device, namely preferably analogous to the spraying of cleaning agent, whereby the components needed for this purpose are not shown in FIGS. 1 and 2 for the sake of clarity. During the rinsing phase, however, the valve 16 is switched such that the mixture of water, cleaning agent, and dirt particles leaves the cooking chamber 1 in discharge direction C via the drain 17 and can be disposed of.

The cleaning phase, the acting phase and the rinsing phase can, for example, be regulated dependent on how dirty the interior of the cooking device is, on the speed of the impeller 4, on the conveyed quantity of the pump 14, on the setting of the valve 16, the filling level of the reservoir 15 and on the temperature of the heating device 7.

Both individually as well as in any arbitrary combination, the features of the invention disclosed in the above specification, in the drawings as well as in the claims can be critical for realizing the various embodiments of the invention.

While the invention has been illustrated and described in detail in the drawings and foregoing description, the same is to be considered as illustrative and not restrictive in character, it being understood that only the preferred embodiment has been shown and described and that all changes and modifications that come within the spirt of the invention are desired to be protected.

I claim as my invention:

1. An apparatus for cleaning an inside of a cooking device having a cooling chamber and a blower chamber separated from the cooking chamber via air baffles, comprising:

an impeller arranged in said blower chamber for generating a conveying stream in the cooking chamber as well as in the blower chamber, at least one spray nozzle for spraying at least one fluid facing toward said impeller, and a spray jet of the at least one spray nozzle in the blower chamber being directed opposite the conveying stream of the impeller.

2. The apparatus according to claim 1 wherein said at least one fluid comprises at least one of the elements selected from the group consisting of cleaning agent, rinse agent, clear rinse agent, decalcification agent, and water.

3. The apparatus according to claim 1 wherein the spray jet of the at least one spray nozzle is radially directed onto the impeller.

4. The apparatus according to claim 1 wherein the at least one spray nozzle is embraced by a nozzle system that preferably comprises at least one nozzle ring concentrically arranged around the impeller.

5. The apparatus according to claim 4 wherein a heating device is arranged between the at least one nozzle ring and the impeller.

6. The apparatus according to claim 1 wherein the at least one spray nozzle is connected to at least one preferably manually fillable reservoir upon interposition of at least one pump.

7. The apparatus according to claim 6 wherein, the at least one reservoir is connected to the cooking chamber upon interposition of at least one first valve, and the cooking chamber is connected to a drain upon interposition of at least one second valve, whereby the first and second valves are preferably implemented as one.

8. The apparatus according to claim 1 wherein a plurality of spray nozzles are provided whose respective spray jets impinge surfaces in the interior of the cooking device that overlap at least in regions.

9. The apparatus according to claim 1 comprising a measuring and control system connected to the motor of the impeller, to the at least one pump, to the at least one valve, to the at least one reservoir and to the heating device for the control of a cleaning regimen.

10. A method for cleaning the inside of a cooking device having a cooking chamber and a blower chamber separated from the cooking chamber via air baffles, comprising the steps of:

generating a conveying stream in the cooking chamber as well as in the blower chamber by use of an impeller in said blower chamber, facing at least one spray nozzle for spraying at least one fluid toward said impeller, and directing a spray jet of the at least one spray nozzle in the blower chamber opposite the conveying stream of the impeller.

11. The method according to claim 10 wherein a first time duration $T_B$ is provided for wetting with at least one fluid wall of the cooking chamber built-in units in the cooking chamber, the blower chamber, and built-in units in the blower chamber, the time duration being defined via an amount M of the at least one fluid adhering to the walls and by average precipitation velocity v of the at least one fluid against the walls.

12. The method according to claim 11 wherein $M=d\cdot A$, where d is a maximum film thickness of the fluid adhering to the walls and A is a surface of the walls, $v=F/A$, where F is the conveying stream of the at least one fluid to the at least one spray nozzle, and $$T_B = \frac{d\cdot\gamma}{v} = d\cdot\gamma\cdot\frac{A}{F}$$

where $\gamma$=v/(lowest precipitation velocity) is a distribution error.

13. The method according to claim 11 wherein the at least one fluid, at least partly by employment of at least one pump, is circulated from at least one reservoir via the at least one spray nozzle and the impeller into the cooking chamber and is recirculated from the cooking chamber to the at least one reservoir, the quantity of circulated fluid being preferably acquired in the at least one reservoir.

14. The method according to claim 13 wherein at least one valve between the at least one reservoir, the cooking chamber and a drain is actuated dependent on a cleaning regimen.

15. The method according to claim 13 wherein a second time duration $T_z$ is acquired within which a quantity of circulated fluid falls below a specific set value.

16. The method according to claim 15 wherein the fluid is distributed in the cooking chamber over a time duration which is determined from at least one of the first time duration $T_B$ and the second time duration $T_z$, an acting phase for the cleaning agent, and a rinsing phase wherein a second fluid in the form of at least one of a rinsing agent, a clear rinsing agent and water is distributed in the cooking chamber over a time duration determined from at least one of the first time duration $T_B$ and the second time duration $T_z$.

17. The method according to claim 16 wherein during the cleaning phase, the first fluid at least partially flows into the at least one reservoir via the at least one valve and, during the rinsing phase, the second fluid at least partially flows from the cooking chamber into the drain via the at least one valve.

18. The method according to claim 11 wherein a cleaning program is provided which is at least one of manually set and sequenced automatically, and which comprises a cleaning phase, an acting phase, and a rinsing phase.

19. The method according to claim 18 wherein the cleaning program is at least one of controlled and regulated dependent on at least one of how dirty the interior of the cooking device is, on a speed of the impeller, on a conveying quantity of the at least one pump, on a position of the at least one valve, on a filling level of the at least one reservoir, and on a temperature in an interior of the cooking chamber.

20. A cooking device, comprising:

a cooking chamber and an adjacent blower chamber separated from the cooking chamber via an air baffle structure;

an impeller arranged in the blower chamber which generates a conveying stream in the cooking chamber as well as in the blower chamber, at least one spray nozzle for spraying at least one fluid facing toward said impeller, and a spray of the at least one spray nozzle in the blower chamber being directed opposite the conveying stream of the impeller.

21. A method for cleaning an inside of a cooking device having a cooking chamber and a blowing chamber separated from the cooking chamber via an air baffle structure having a central operative, comprising the steps of:

generating a conveying stream in the cooking chamber as well as in the blower chamber by an impeller arranged in the blower chamber which pulls air into the blowing chamber through said central aperture;

spraying at least one fluid with a plurality of spray nozzles arranged around the impeller toward the impeller, and directing respective spray jets of the spray nozzles in the blower chamber opposite the conveying stream of the impeller.

22. The method according to claim 21 including the step of providing the at least one fluid as at least one of a cleaning agent, a rinse agent, a clear rinse agent, a decalcification agent, and water.

* * * * *